US005746518A

United States Patent [19]

Ogawa et al.

[11] Patent Number: 5,746,518

[45] Date of Patent: May 5, 1998

[54] BRAILLE PRINTING APPARATUS

[75] Inventors: Takashi Ogawa, Kanagawa-ken; Toshiya Tsukasa, Hadano, both of Japan

[73] Assignee: Ricoh Co., Ltd., Tokyo, Japan

[21] Appl. No.: 607,455

[22] Filed: Feb. 27, 1996

[30] Foreign Application Priority Data

Mar. 30, 1995 [JP] Japan ..... 7-073261
Aug. 29, 1995 [JP] Japan ..... 7-220686

[51] Int. Cl.[6] ..... B41J 3/32; B41J 2/255

[52] U.S. Cl. ..... 400/109.1; 400/124.29

[58] Field of Search ..... 400/109.1, 121.29, 400/124.3, 127, 132, 122

[56] References Cited

U.S. PATENT DOCUMENTS 4,183,683 1/1980 Hiratsuka et al. ..... 400/122
4,261,663 4/1981 Grimnes ..... 400/122
5,193,921 3/1993 Tsukuda et al. ..... 400/122
5,209,584 5/1993 Galarneau ..... 400/122
5,502,965 4/1996 Hornhauer et al. ..... 60/326
5,527,117 6/1996 Roy ..... 400/109.1

*Primary Examiner*—Edgar S. Burr
*Assistant Examiner*—Dave A. Ghatt
*Attorney, Agent, or Firm*—Oblon, Spivak, McClelland, Maier & Neustadt, P.C.

[57] ABSTRACT

An apparatus for printing not only embossing braille characters but also an embossing figure on a recording medium such as paper, using a projection of a rod employed as a debossing die and a printing underlay employed as an embossing die. The printing underlay includes at least one elastic layer. The apparatus includes an element to stop a depressing depth of the projection into the printing underlay so that the depressing depth is uniform. The element to stop the depressing depth of the projection into the printing underlay may include a step formed on a part of a periphery of the printing rod, and additionally a stopping wall whereby the depressing depth of the projection into the printing underlay is stopped by the step knocking against the stepping wall. Different projections with different step positions may also be provided.

2 Claims, 7 Drawing Sheets

FIG. 8
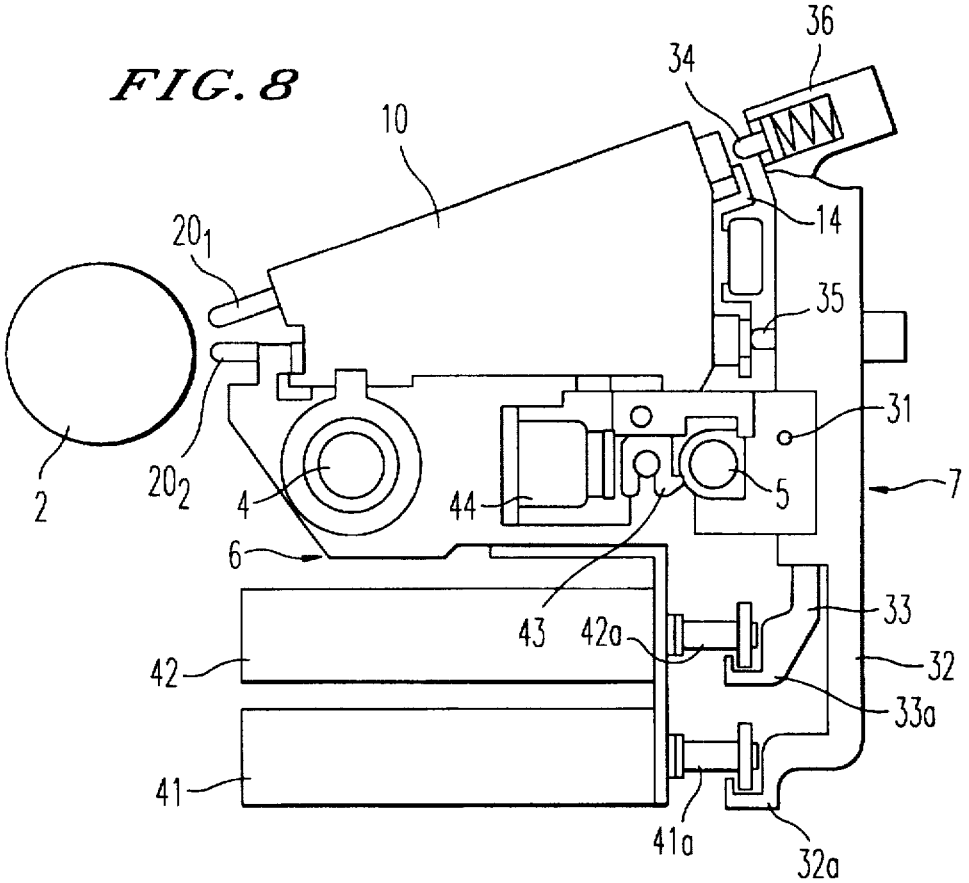
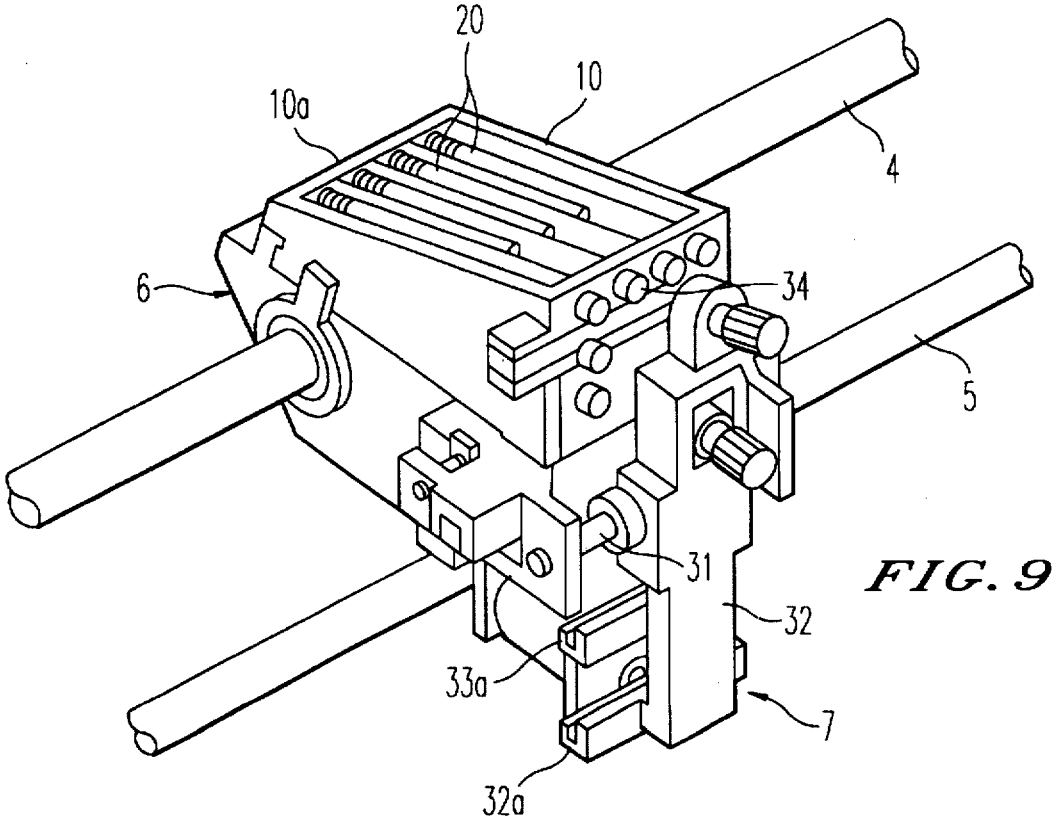
FIG. 9

BRAILLE PRINTING APPARATUS

BACKGROUND OF THE INVENTION

1. Field of the Invention

The present invention relates to a braille printing apparatus, and more particularly to an apparatus that prints not only embossing braille characters but also an embossing figure.

2. Discussion of the Background

Braille is printed as a series of raised dots on a medium such as paper in which each character is represented as a dot pattern, forming the basic braille written units that are read by touch. Special braille writers, braille typewriters and the like are used to write braille. Braille may be printed using a zinc printing plate in which character dot impressions are produced. A typesetting machine is then used to produce a printing plate from the zinc printing plate. The printing plate is then pressed onto the surface of the recording medium, e.g., paper, to produce the printed braille material.

In braille typewriters, braille is printed on a recording medium, such as paper, using a hard braille plate employed as an embossing die and a printing rod having a pin-shaped projection employed as a debossing die.

FIGS. 1(*a*)–1(*c*) show a way to print braille in a background braille typewriter. A braille plate 200 has many recesses 200*a* forming a two dimensional matrix of recesses 200*a* on the surface of the braille plate 200. A recording medium P, such as paper, is placed on the surface of the braille plate 200, and is pressed by a projection 201 of a printing rod that fits required recesses 200*a* of the braille plate 200, see FIG. 1(*a*) and FIG. 1(*b*), and this results in making an embossing braille P1, see FIG. 1(*c*).

This type of braille typewriter that makes an embossing at a uniform position fixed by the recesses 200*a* of the braille plate 200 is used for only embossing braille characters, and cannot be used for embossing a figure. Accordingly, another type of braille typewriter is contemplated that has a braille plate made of soft synthetic rubber so that it can be used for embossing a figure.

FIGS. 2(*a*)–2(*c*) show a way to print braille with another type of background braille typewriter. A braille underlay 100 employed in a manner similar to the braille plate 200 of FIG. 1 is made of soft synthetic rubber. A recorded medium P, such as paper, placed on the surface of the braille underlay 100 is pressed by the projection 101*a* of the printing rod at any required position at will, see FIG. 2(*a*) and FIG. 2(*b*), and the result is that an embossing braille P1 is formed, see FIG. 2(*c*).

FIG. 3 shows a type of background braille typewriter using the soft printing underlay 100 such as is shown in FIG. 2 as disclosed in Japanese Laid-Open Utility Model Application (KOKAI-JITSUYO) 56-24244. In this device the recording medium P is held by a spring 108 on a platen 100 and is pressed by the projection 101*a* of a printing rod 101 having a pin-shaped projection 101*a* employed as a debossing die, to make embossing points on the recording medium P. A first pulse motor 102 at one end of spindle 12 of the platen 100 drives the platen 100 in forward and reverse rotations. The rod 101 may be moved by a second pulse motor 107, rod 101 being slidably supported by shaft 104, and rod 101 is connected with wire 106 formed over rollers 105 and 103.

In this type of braille typewriter, the underlay 100 has enough thickness to stop a depth of the embossing and absorb the shock of the pressure of the projection 101*a*.

However, by virtue of the elasticity of the underlay 100, particularly the loss of elasticity of underlay 100 over time, and particularly at areas of heavy use, the depressible depth of the underlay 100 does not become uniform in proportion to a dispersion of hardness of the surface of the underlay 100. In some cases, the projection 101*a* of the printing rod 101 may tear and break the recording medium P by pressing it too deep.

SUMMARY OF THE INVENTION

In view of the foregoing drawbacks in the background braille writing systems, one object of the present invention is to provide a novel braille printing apparatus which prints embossing points at uniform depths.

Accordingly, another object of the present invention is to provide a novel braille printing apparatus which can accommodate different types of recording mediums, including recording mediums of different thicknesses.

In accordance with the present invention, these objects of the present invention are attained by a novel braille printing apparatus which includes a pin-shaped projection employed as a debossing die. A printing underlay is employed as an embossing die, and is made of an elastic material. The printing underlay is set up against the projection through the recording medium. An element to stop a depressing depth of the projection into the printing underlay is also provided, so that the depressing depth of the embossing projections are uniform. Different projections with different depressing depths can also be provided, to optionally address different recording mediums, including of different thicknesses.

Such a printing underlay may also find particular application in the form of a roller against which a braille writing is performed.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawing, wherein:

FIG. 8 is an enlarged side view of a printing head of FIG. 6;

FIG. 9 is an enlarged perspective view of the printing head of FIG. 8;

DETAILED DESCRIPTION OF THE PREFERRED EMBODIMENTS

Figure 1A:
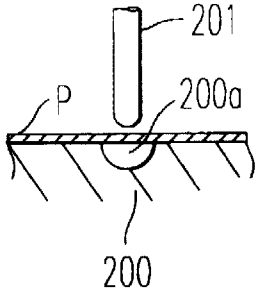
FIG. 1a BACKGROUND ART
FIGS. 1(*a*)–1(*c*) show a way to print braille in a background braille typewriter using a hard braille plate.
Figure 1B:
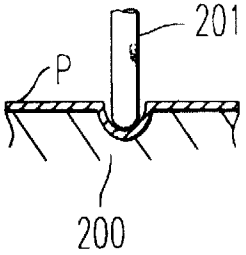
FIG. 1b BACKGROUND ART
Figure 1C:
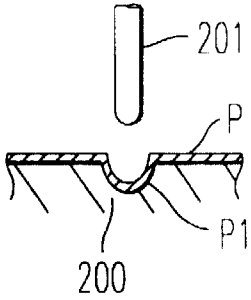
FIG. 1c BACKGROUND ART
Figure 2A:
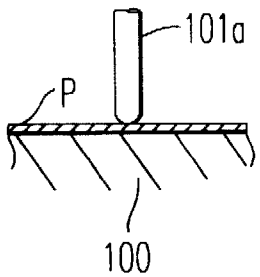
FIG. 2a BACKGROUND ART
FIGS. 2(*a*)–2(*c*) show a way to print braille in another type of background braille typewriter using a soft printing underlay.
Figure 2B:
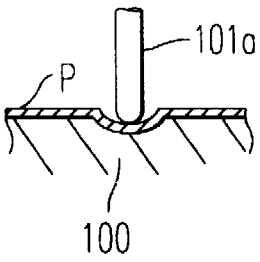
FIG. 2b BACKGROUND ART
Figure 2C:
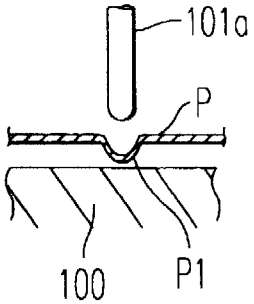
FIG. 2c BACKGROUND ART
Figure 3:
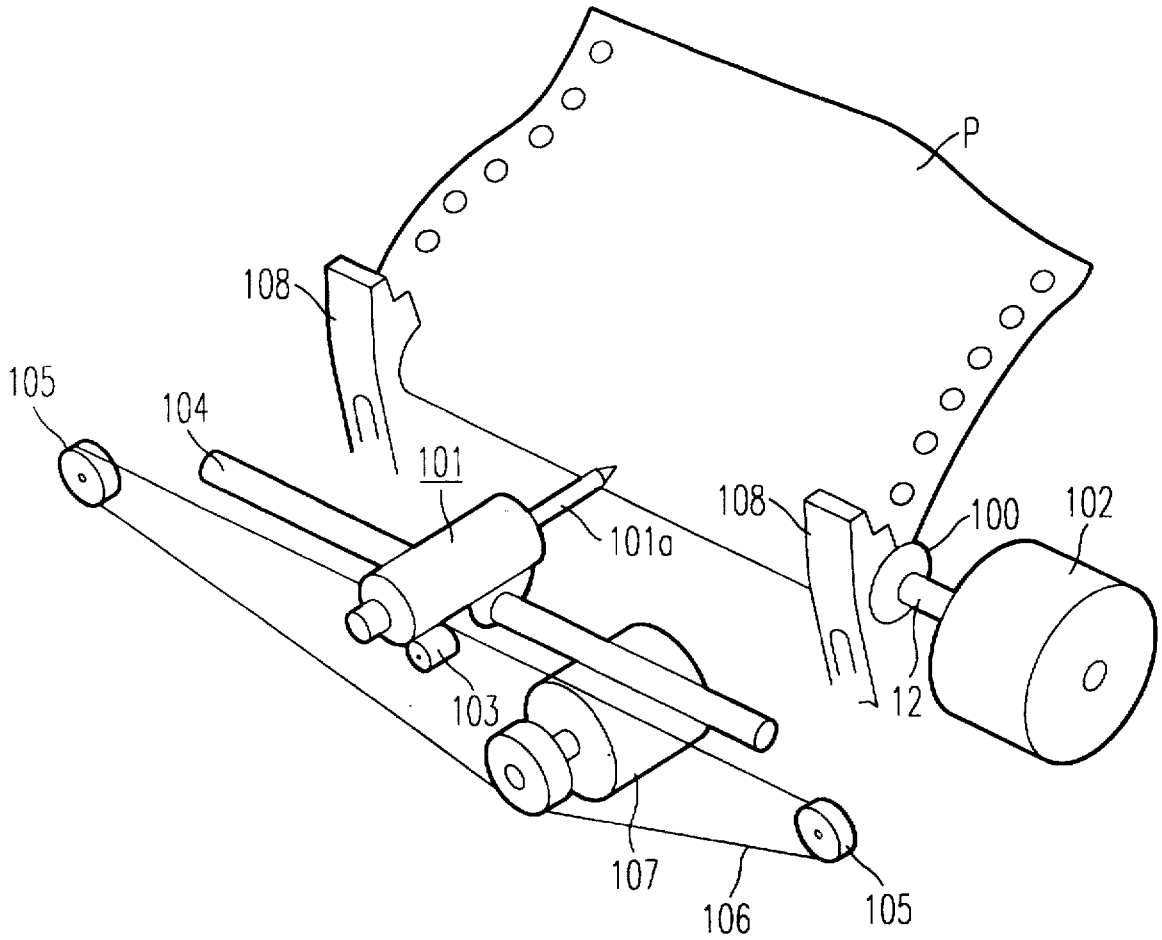
FIG. 3 BACKGROUND ART
FIG. 3 shows a type of background braille typewriter using the soft printing underlay such as in FIG. 2.
Figure 4:
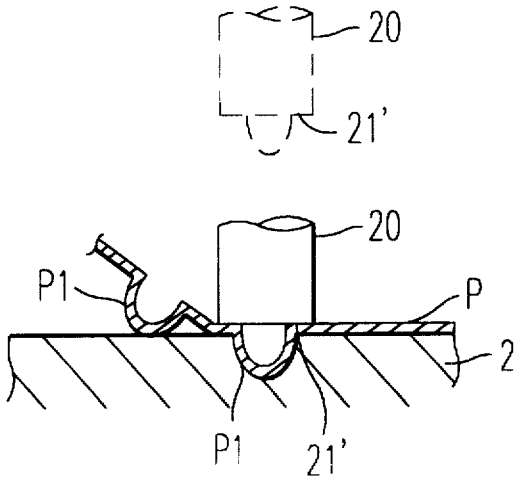
FIG. 4 shows an embodiment of the present invention in which a projection of a rod includes a step for stopping a depressing depth of the projection.

Referring now to the drawings, wherein like reference numerals designate identical or corresponding parts throughout the several views, and more particularly to FIG. 4 thereof, the embodiments of the present invention are now described in further detail.

Referring now to FIG. 4, there is shown a printing underlay 2, functioning as an embossing die, a recording medium P, such as a sheet of paper, and a pin-shaped projection 20, to strike against the printing underlay 2 through the recording medium P, employed as a debossing die. The debossing die 20 includes a step 21' functioning to stop a depressing depth of the projection into the printing underlay 2 by abutting against the printing underlay 2 so that the depth of the embossing is uniform. The recording medium 2 is pressed by the projection 20 at any required position needed to make any letter or shape, thereby to make an embossing point, the dashed projection 20 showing the projection 20 before it is pressed against the recording medium P and into the underlay 2. As the step 21' works to stop a depressing depth of projection 20 into the printing underlay 2, an embossing braille P1 is formed uniform in depth.

However, in this device of FIG. 4 in a case that the embossing brailles are to be formed close to each other, the neighboring embossing brailles may be crushed flat or the recording medium P may be folded down between each embossing braille by the step 21' of the projection 20 pressing against the recording medium P.

To overcome this drawback, as a further embodiment of the present invention, an apparatus may include a structure to stop a depressing depth of a projection into the printing underlay which is set at a different part of the rod having the projection. For example, a stop can be provided at a holder supporting the printing rod having a projection instead of forming the step 21' near the tip of the projection 20 as in the embodiment of FIG. 4.

The structure to stop the depressing depth of the projection into the printing underlay may further include a step formed on a part of a periphery of the printing rod, and a stopping wall formed in a projection holder, whereby the depressing depth of the projection into the printing underlay is stopped by the step knocking against the stopping wall. The step may, as an example, be constructed by a step formed throughout an entire periphery of a middle part of the printing rod, and the stopping wall may be constructed by a wall having a hole through which the projection of the printing rod is able to pass, but in which a diameter of the hole is smaller than an outer diameter of the step.

The stopping wall may be constructed by a cylindrical material supporting the printing rod, in which a diameter of the cylindrical material is less than an outer diameter of the step formed throughout the entire periphery of the middle part of the printing rod, but the stopping wall is not limited to these constructions.

On the other hand, different types of recording mediums, such as recording mediums with different thicknesses, may require different depressing depths of the projection into the printing underlay, or may be more efficiently utilized with different projections.

In view of this foregoing requirement, an apparatus of the present invention may further have a plurality of printing rods having different projections or depressing depths as is needed, and the elements to stop the depressing depth of the projections into the printing underlay may be set into a holder supporting all of the plurality of printing rods so that the depressing depth of each projection is individually selected.

The element to stop the depressing depth of the projection into the printing underlay may further include elements to adjust the depressing depth of the projection to adjust the depressing depth of the projection to a depth required for a selected recording medium.

Figure 5:
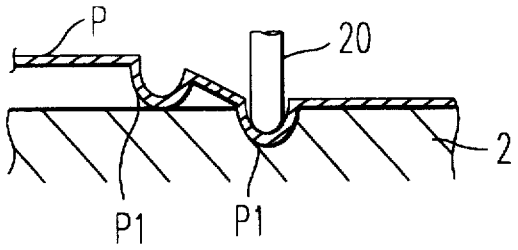
FIG. 5 shows another embodiment of the present invention in which a rod includes a step for stopping a depressing depth of a projection of the rod, the step being located away from a tip of the projection.

FIG. 5 shows a state of a printing embossing braille P1 by the foregoing apparatus in which the elements for stopping the depressing depth of the projection 20 are located away from the tip of the projection 20 (and thus are not shown in FIG. 5). A braille underlay 2 employed as an embossing die may be made of an elastic substance. A recording medium P, such as paper, is placed on the surface of the braille plate 2 and is pressed by the projection 20 of the printing rod at any required position at will, and the result is that an embossing braille P1 is formed evenly and can form any character and any figure excellently on the recording medium P as a depressing depth of the projection 20 into the printing underlay is stopped by elements, shown in the following Figures, to stop a depressing depth of the projection 20 into the printing underlay 2.

The projection 20 has a tip of a shape of a pen. The projection 20 may be made of, as an example, a metal such as aluminum, or a resin such as a plastic. The elastic layer 2 of the printing underlay 2 is made of a relative low solidity material, such as rubber or a soft synthetic resin, but the printing underlay 2 is not limited to these materials.

Figure 6:
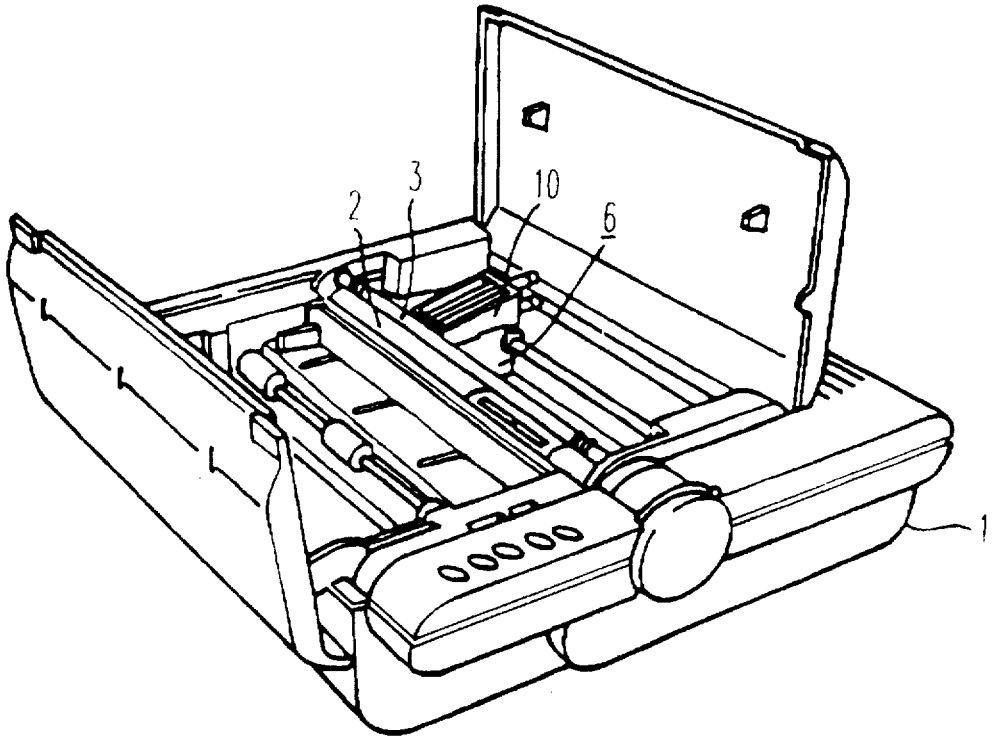
FIG. 6 is a perspective view illustrating an external view of a braille printing apparatus according to the present invention.
Figure 7:
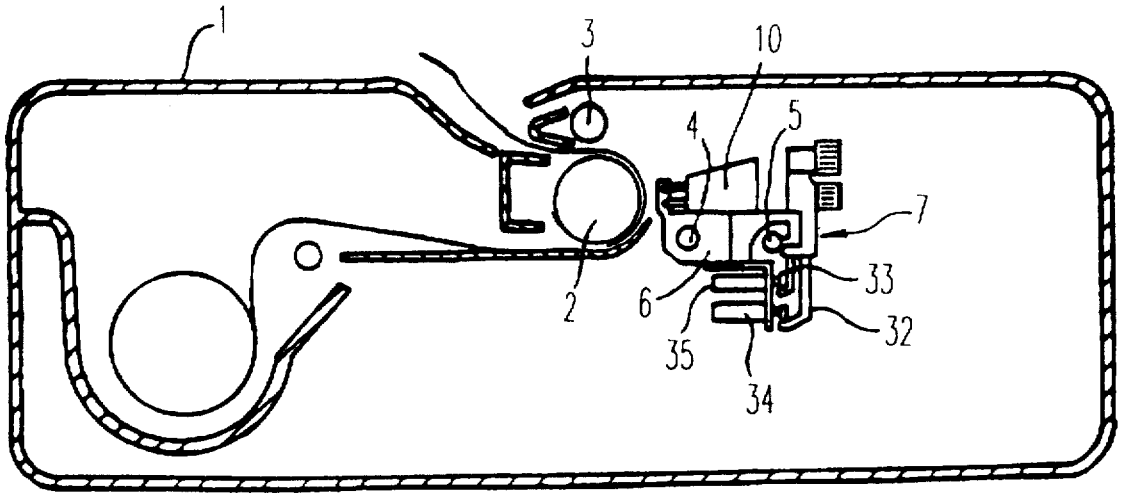
FIG. 7 is a schematic sectional side elevation view of the device of FIG. 6.

FIG. 6 is a perspective external view of a braille printing apparatus according to the present invention, and FIG. 7 is a schematic sectional side elevation view of the device of FIG. 6.

In FIG. 6 and FIG. 7, a body 1 has a platen 2 functioning as a printing underlay (embossing die), a pressing bar 3 pressing a recording media P, such as paper, onto the platen 2, and a printing head 6 making an embossing on the recording medium P. The platen 2 sets horizontally to permit rotational movement of itself relative to the body 1 by a driving portion and which feeds the recording medium P. A surface of the platen 2 may be made of an elastic layer such as rubber or a soft synthetic resin.

The printing head 6 is supported horizontally by a guide shaft 4 made of a material such as metal, and another guide shaft 5 made of a material such as metal is included to permit horizontal movement of the printing head 6 relative to the body 1 along these shafts 4 and 5 by a driving portion.

FIG. 8 is an enlarged side view of the printing head 6, and FIG. 9 is an enlarged perspective view of the printing head 6.

The printing head 6 includes a rod holder 10 and a plurality of printing rods $20_1$ and $20_2$ supported by the rod holder 10.

Figure 10:
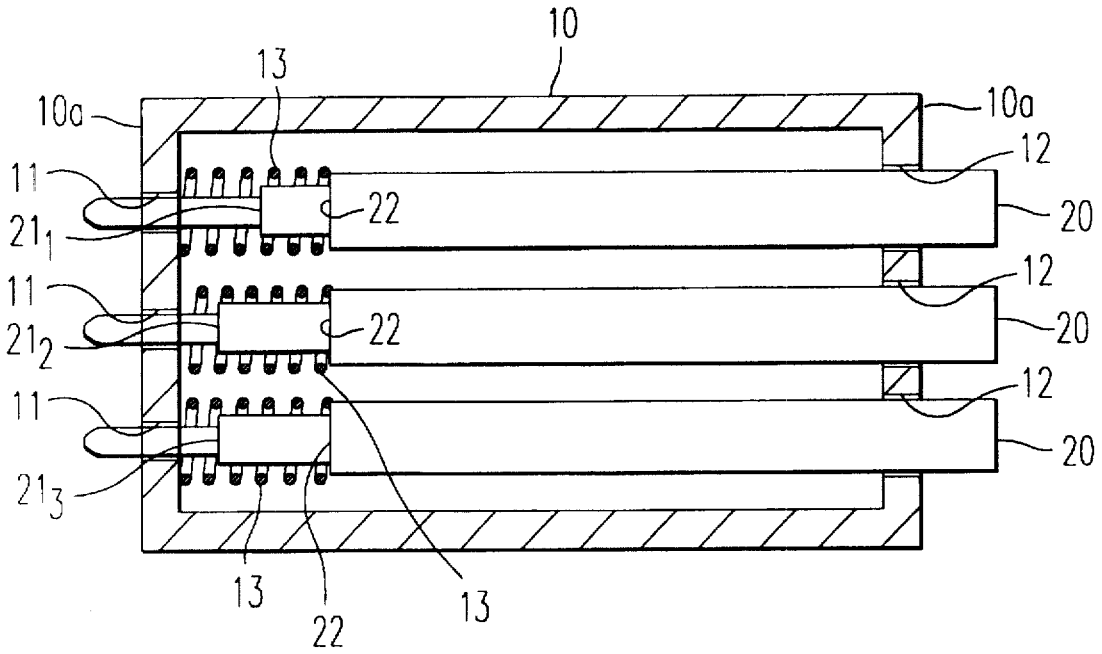
FIG. 10 is an enlarged horizontal section view illustrating a way of supporting a plurality of printing rods by a rod holder.
Figure 11:
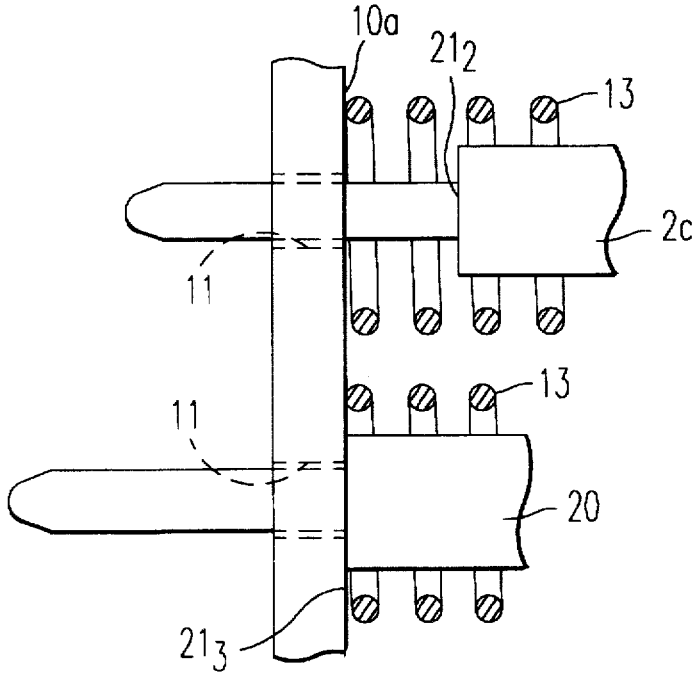
FIG. 11 is an enlarged view of a part of the device of FIG. 10.

FIG. 10 is an enlarged horizontal section view illustrating how the plurality of printing rods 20 are supported by the rod holder 10. FIG. 11 is an enlarged view of a part of FIG. 10.

The rod holder 10 has a plurality of front holes 11 in a front wall 10*a* of the holder 10 supporting a front part of each movable rod 20, and another plurality of rear holes 12 in a rear wall 10*b* of the holder 10 supporting a rear part of each movable rod 20. Each of the plurality of printing rods 20 has a projection at a tip of the printing rod 20 and a respective step $21_1$–$21_3$ formed throughout an entire periphery of the printing rod 20 a distance away from the tip. An outer diameter of each step $21_1$–$21_3$ is larger than a diameter of the front hole 11 so that the depressing depth of the projection 20 into the platen 2 is stopped by the steps $21_1$–$21_3$ knocking against the front wall 10*a* outside the circumference of the front hole 11.

Each of the plurality of printing rods 20 has another step 22 formed throughout the entire periphery of the printing rod 20 a further distance away from the tips thereof. A spring 13 is held between the further steps 22 and the front wall 10*a* so that the printing rods 20 are biased away from the wall 10*a*.

Referring now again to FIG. 8 and FIG. 9, the printing head 6 has a driving portion 7 which sets around the shaft 5, which moves the printing rods 20 forward for depressing into the platen 2, i.e. a recording medium placed against the platen 2. In FIG. 8 and FIG. 9, an upper plurality of printing rods $20_1$ and a lower plurality of printing rods $20_2$ are provided so that the driving portion 7 has two parts. The first part of the driving portion 7 has a first electromagnetic cylinder 41 having a first rod 41*a*, supplying a driving force to the upper printing rods $20_1$, a first arm 32 permitting rotational movement around an axle 31, and a first projection 34 formed in a pin shape, and fixed at an end of the first arm 32. A first guide rail 32*a* is fixed at the other end of the first arm 32 and is joined to the first rod 41*a* of the first electromagnetic cylinder 41. The second part of the driving portion 7 similarly has a second electromagnetic cylinder 42 having a second rod 42*a*, supplying a driving force to the lower printing rods $20_2$, a second arm 33 set within the first arm 32 permitting rotational movement around an axle 31, a second projection 35 formed in a pin shape, fixed at an end of the second arm 33. A second guide rail 33*a* is fixed at the other end of the second arm 33 and is joined to the second rod 42*a* of the second electromagnetic cylinder 42.

The driving portion 7 is slidably supported within a guide shaft 5. The printing head 6 further includes a joined hook 43 joining the driving portion 7 to the rod holder 10, and a third electromagnetic cylinder 44 for moving the joined hook 43 for connecting or disconnecting the driving portion 7 to the rod holder 10. The driving portion 7 is able to be moved with the rod holder 10 while the joined hook 43 joins the driving portion 7 to the rod holder 10, and thus the rod holder 10 is permitted to move horizontally relative to the body 1 along the shafts 4 and 5. As the relative position of the driving portion 7 and the rod holder 10 is fixed while they are joined to each other, the driving portion 7 is able to select a rod $20_1$ or $20_2$ by operation of the respective projection 34 and projection 35. The selected printing rod 20 is able to move only up to a limit of a prescribed depth and each printing rod includes a step 21 which is stopped by knocking the step 21 against the front wall 10*a* outside the circumference of the front hole 11, as the driving force of the first and second electromagnetic cylinder 41, 42 is large enough. The projection 34 and projection 35 have a spring 36 at the back to absorb the shock of knocking against the printing rod 20.

The device of the present invention includes two groups of printing rods $21_1$ and $20_2$. These two groups of printing rods are utilized to maximize the flexibility of the device of the present invention. For example, in a braille printing writer such as in the present invention, different types of materials can be written on, the simplest example being papers of different depths. When printing braille on these different materials, it may be ideal that these different materials are best written on by projections of different shapes or at different depths. That is, the thicker the paper on which the braille is written, the greater the depth of the projection 20 into the paper may be desired. Similarly, based on the different types of recording materials, projections with slightly different tips, for example having slightly different dimensions, may be ideal. In the present invention the use of different types of printing rods $20_1$ and $20_2$ allows an operator to make a selection of the optimum printing rod for the recording medium chosen. Furthermore, if an operator wishes to choose each of the printing rods $20_1$ and $20_2$ to be identical, this would then prolong the life of the printing head 6 of the present invention.

Furthermore, according to the present invention, and as is shown in FIG. 10 of the present specification as an example, to implement the differences between the printing rods each printing rod may have a different step position. As shown in FIG. 10, a step position $21_1$ can be provided for one printing rod 20, which is different from the step position $21_2$ for a second printing rod 20. With such a structure in the present invention, the printing rod with the step $21_1$ will form an embossing of a greater depth as it impinges into a recording medium. As discussed above as an example, this printing rod with the step $21_1$, which is a greater distance from the wall 10*a* than that of the step $21_2$, may be used for a thicker recording medium. In conjunction with this, these different printing rods 20 may have tip portions of slightly different shape, and further differences in the positions of the steps 21 can be implemented. That is, the present invention is not limited to only two different positions of the steps 21 and the use of only three printing rods as shown in FIG. 10. Various printing rods with various positions of steps 21, and with various tips, can be implemented in the present invention.

Further, the printing head 6 has a block plate 14 for stopping the backward movement of the printing rod 20.

The recording medium P fed onto the platen 2 and pressed to be held by the pressing bar 3 onto the platen 2 is pressed by the projection of the selected printing rod 20 moved by the driving portion 7 at any required position at will, and the result is that an embossing braille is formed evenly and can make any character and any figure excellently on the recording medium P.

Figure 12:
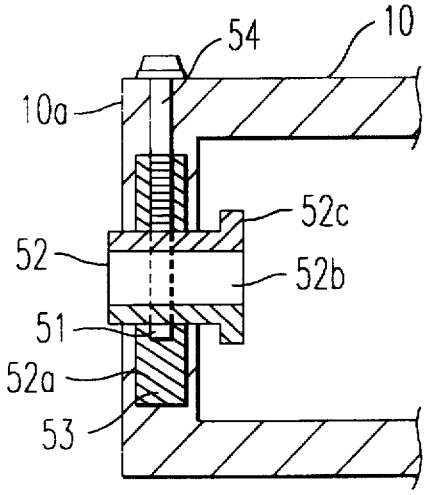
FIG. 12 shows an embodiment of an element to adjust the depressing depth in a sectional side elevation.

The apparatus of the present invention may further include an element to further adjust the depressing depth of the projection of the printing rod 20 into the printing underlay. FIG. 12 shows an embodiment of a structure to adjust the depressing depth by a sectional side elevation, wherein there is a cylindrical element 52 provided instead of the front hole 11 of FIG. 10. The cylindrical element 52 has a hole 52*b* of the same size of the front hole 11 of FIG. 10 and a lip portion 52*c*. The printing rod 20 will pass through this hole 52*b*. The cylindrical element 52 is movable a distance toward and away from the front wall 10*a* by a male screw 52*a* formed on the cylindrical element 52 and a female screw 51 formed on the front wall 10*a*, which is able to adjust the depressing depth by turning screw 54, which is formed in a hollowed out area 53.

That is, in the structure of the present invention, the outside of the cylindrical element 52 is rotated as a screw within the wall 10*a*. The movement of this portion 52 is controlled by adjustment of the screw 54. That is, the screw 54 contacts a periphery of the portion 52. The screw portions of the screw 54 contact opposite screw portions of the element 52 so that as the screw 54 is rotated, the element 52 is rotated so that the lip portion 52*c* moves towards and away from the wall 10*a*. This lip portion 52*c* is further provided to limit a movement of the element 52.

According to an experiment of the Applicant, in an apparatus included a structure to stop a depressing depth of a projection such as in FIGS. 6 to 11, only one in 72 of embossing brailles broke. In an apparatus without a structure to stop a depressing depth of a projection in an otherwise similar apparatus, 14 in 32 of embossing brailles broke.

As this invention may be embodied in several forms without department from the spirit of essential characteristics thereof, the present embodiment is therefore illustrative and not restrictive, since the scope of the present invention is defined by the appended claims rather than by the description preceding them, and all modifications that fall within the meets and bounds of claims, or equivalence of such meets and bounds, are therefore intended to be embraced by the claims.

What is claimed as new and desired to be secured by Letters Patent of the United States is:

1. A braille writing apparatus for writing braille on a recording medium placed against an underlay comprising:

at least one projection for pressing into the recording medium against the underlay to make an embossing on the recording medium; and means, formed on the at least one projection, for limiting a depth of the at least one projection into the recording medium;

wherein the means for limiting a depth of the at least one projection comprises a step formed on the at least one projection having a greater outer diameter than the at least one projection, and wherein the at least one projection is formed in a projection holder having a front wall and a hole formed in the front through which the projection projects, the diameter of the hole being less than the outer diameter of the step so that the step abuts against the front wall to limit a depth of the projection into the recording medium; and wherein the hole of the front wall contains a movable screw element which moves to change a depth of the projection into the recording medium.

2. A braille writing apparatus for writing braille on a recording medium placed against an underlay comprising:

a platen against which the recording medium is placed;

a printing head comprising:

at least one projection for pressing into the recording medium against the underlay to make an embossing on the recording medium; and means, formed on the at least one projection, for limiting a depth of the at least one projection into the recording medium;

wherein the printing head further comprises a projection holder holding the at least one projection, and the means for limiting a depth of the at least one projection comprises a step formed on the at least projection having a greater outer diameter than the at least one projection, and wherein the at least one projection is formed in the projection holder having a front wall and a hole formed in the front wall through which the projection fits, the diameter of the hole being less than the outer diameter of the step so that the step abuts against the front wall to limit a depth of the projection into the recording medium; and wherein the hole of the front wall contains a movable screw element which moves to change a depth of the projection into the recording medium.

* * * * *